US006077132A

United States Patent [19]

Gligorijevic

[11] Patent Number: 6,077,132

[45] Date of Patent: Jun. 20, 2000

[54] ELECTRICAL CONNECTOR WITH REPLACEABLE PIN CONTACTS NOT REQUIRING ACCOMPANYING RE-TERMINATION

[75] Inventor: Greg Gligorijevic, Simi Valley, Calif.

[73] Assignee: WPI/Viking, Chatsworth, Calif.

[21] Appl. No.: 09/179,259

[22] Filed: Oct. 26, 1998

[51] Int. Cl.[7] ..... H01R 9/24

[52] U.S. Cl. ..... 439/891

[58] Field of Search ..... 439/891, 801, 439/924, 474, 475, 152, 153, 155

[56] References Cited

U.S. PATENT DOCUMENTS 2,405,412 8/1946 Eby ..... 439/891

3,210,720 10/1965 Harris, Jr. ..... 439/891

4,944,686 7/1990 Gertz ..... 439/175

5,791,919 8/1998 Brisson et al. ..... 439/166

*Primary Examiner*—Khiem Nguyen

*Assistant Examiner*—J. F. Duverne

*Attorney, Agent, or Firm*—George J. Netter

[57] ABSTRACT

An electrical receptacle (32) mounted to an aircraft (10) includes a pin contact assembly (34) having a pin body (62) releasably threaded within a threaded insert (38). A collet (70) enhances mechanical securement and electrical contact between the insert (38) and pin body (62). The outer end of the pin body (62) is configured (76) to receive a wrench for assembly disassembly of the parts.

9 Claims, 2 Drawing Sheets

ELECTRICAL CONNECTOR WITH REPLACEABLE PIN CONTACTS NOT REQUIRING ACCOMPANYING RE-TERMINATION

BACKGROUND

1. Background of the Invention

The present invention relates generally to an electrical connector having parts which can be selectively mated to and unmated from one another, and, more particularly, to pin contacts for such a connector which has individual parts that are replaceable without requiring re-termination.

2. Description of Related Art

A well-known electrical connector includes plug and receptacle parts which can be selectively mated together and unmated, with individual cable wires connected to pin contacts on the plug being interconnected (or disconnected) with socket contacts carried by the receptacle part. There are many situations in which plug and receptacle connectors because of being subjected to strain and vibration result in their pin contacts becoming bent or broken. One such use context which presents especially difficult problems of this kind is the temporary connection and disconnection of mobile electrical power source equipment to aircraft while parked at an airfield. More particularly, after an aircraft has landed and shut down its engines, it does not have sufficient onboard electrical power for operating such things as air conditioning equipment, for example. Accordingly, it is conventional practice after the aircraft has landed, that an electrical power source carrying vehicle drives onto the field to a point adjacent the aircraft and mates an electrical power cable via a connector part to a complementary connector part affixed to the aircraft. The latter connector part is most frequently mounted to the underside of the aircraft or occasionally on a fuselage sidewall, adjacent the cockpit which can require considerable lifting and manipulation effort due to the relatively heavy connector part at the cable end as well as the cable weight itself.

Those skilled in the electrical connector arts generally refer to a connector part having a "pin" as a "plug connector", and the connector part including "socket" contacts within which pin contacts are received are referred to as a "receptacle connector". Quite frequently, the connector parts are simply referred to as "plug" and "receptacle". However, in the specific context of interconnecting mobile electric power equipment to an aircraft, the connector part secured to the aircraft is referred to as a "receptacle", and the connector part at the end of the cable is called a "plug". To insure consistency and clarity of understanding the aircraft usage in this connection will be followed.

Both connector parts experience plating and base metal wear from (1) repeated connections/disconnections which is exacerbated from excessive side loads if there is plug/receptacle misalignment, (2) "walking" the cable to overcome required mating force, and (3) high cantilever loads from excessively large cable weights. All of these connections can also result in pin contacts becoming bent to the point of preventing mating, or accelerate wear and necessary mating force, which are undesirable.

On a fuselage-mounted present-day receptacle becoming damaged to the point of unmateability, this can require many hours of work repairing or replacing the receptacle, which usually must be done within a hanger or repair shop area. Also, during this repair time the aircraft cannot be flown if the connector part on the aircraft is being repaired.

On the other hand, when current known plug contacts become unusable, this necessitates returning the cable and damaged plug connector part to the manufacturer for overmolding and re-termination of the plug to the cable wires. Downtime for the associated aircraft could result if spares were lacking.

It is, therefore, a desideratum to provide an electrical receptacle connector part with its pin contacts being individually replaceable without the need for re-termination to aircraft internal wiring.

SUMMARY OF THE INVENTION

In accordance with the practice of the present invention there is provided a pin contact assembly for use in an electrical connector part including an insert to which a cable wire can be conventionally connected. The insert also includes a threaded opening for receiving a similarly threaded end portion of an elongated pin contact. Adjacent the threaded contact end portion is a tapered portion onto which is slidingly received a collet having a tapered opening of a first angle and an outer peripheral tapered surface of a second angle. On assembly of the pin contact, the collet tapered outer periphery abuts against tapered walls within the insert opening. An outer end of the pin contact includes a shallow opening therein of cross-sectional configuration for receiving, say, an Allen hex-head wrench therein for tightening the contact or loosening it, as required.

BRIEF DESCRIPTION OF THE DRAWINGS

These and other objects of the present invention will become more readily apparent upon reading the following detailed description and upon reference to the attached drawings in which.

DESCRIPTION OF A PREFERRED EMBODIMENT

Figure 1:
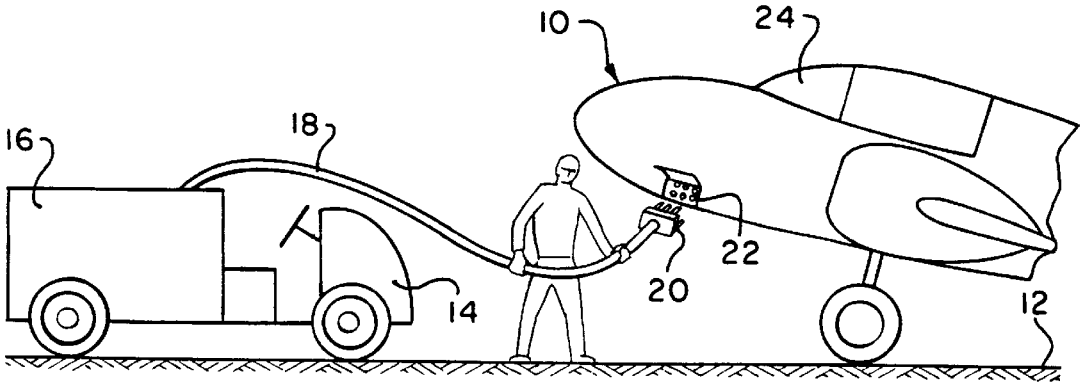
FIG. 1 PRIOR ART
FIG. 1 is an elevational schematic view of an aircraft being interconnected with an auxiliary power source.

Turning now to the drawings and particularly FIG. 1, there is shown in schematic representation a typical commercial aircraft 10 parked on an airfield 12, which for present purposes will be assumed to have recently landed and the pilot has shut off the engine. With the engine shut down, the major electrical power generating equipment on board the aircraft is also shut down. However, there is still need for electrical power to operate a number of different apparatus in the aircraft at this time and this is conventionally provided by a vehicle 14 with electrical power generating equipment 16. In use, the vehicle moves into proximity to the front of the aircraft and interconnects a cable 18 from the equipment 16 to the aircraft via a plug connector part 20 at the end of the cable which fittingly mates with a receptacle connector part 22 affixed to the aircraft fuselage below the cockpit 24, for example. The cable and plug are bulky and heavy as a result of having to handle a relatively high electrical power exchange making interconnection handling awkward and requiring difficult and tiring manipulation of the plug and cable. Moreover, since the cable and plug are exposed to environmental extremes, they must be of robust (i.e., heavy) and rugged construction for maximum reliability.

As already alluded to, the plug 20 and receptacle 22 are of a well-known variety in which pin contacts on the receptacle are slidingly received within socket contacts of the plug to effect electrical power interconnection between the cable 18 and other equipment on board the aircraft. Such connectors are not only subject to normal wear caused by the frictional engagement of pin contacts within receiving socket contacts, but also the pin contacts tend to become bent as a result of twisting and cantilevering of the plug during mating and unmating of the connector parts. When the wear or bending of the pin contacts becomes severe enough, misalignment of connector parts can result in an inoperative connector requiring repair or replacement.

Figure 2:
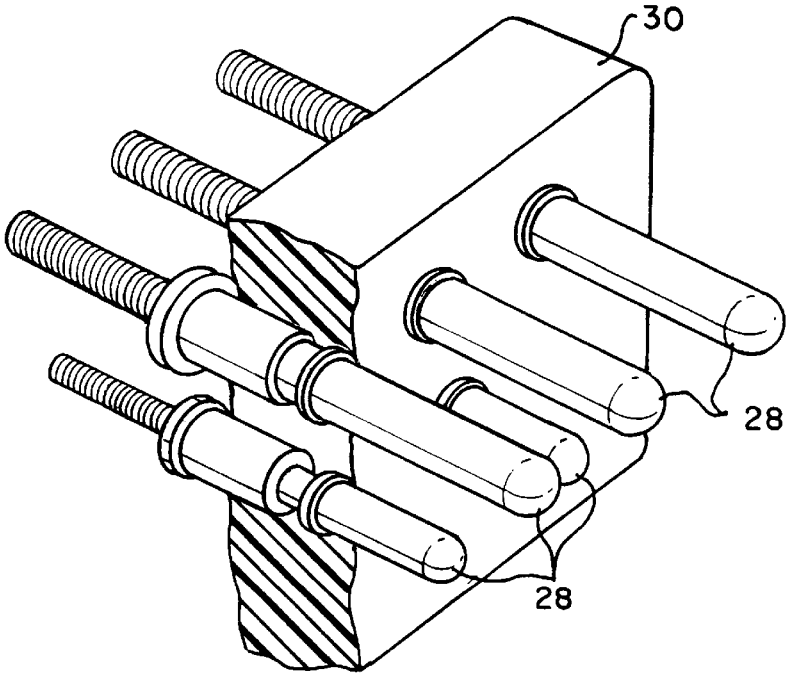
FIG. 2 PRIOR ART
FIG. 2 is a perspective partially fragmentary view of a prior art receptacle connector with one-piece pin contacts.

A prior art receptacle connector part 26 as shown in FIG. 2 is seen to include a plurality of generally cylindrical pin contacts 28, which may be of different lengths, each having one end anchored into a molded insulative base member 30. More particularly, the pin contacts 28 are parallel to each other and extend away from a common side of the base member 30. Each contact is terminated (connected) in a conventional manner to an individual cable wire (not shown), to equipment located within the aircraft.

On the contacts 28 becoming excessively worn or bent out of mutually parallel relation to the extent that they cannot be mated with a complementary connector part, or become broken, this will require repair or replacement of the connector part 22, and remounting to the aircraft with re-termination internal aircraft equipment cable wires. Also, if the connector part 20 becomes damages, such repair or replacement necessitates removal of the cable in a repair shop after which the contacts are replaced, the base overmolded and retermination of the cable wires is effected. In either case, the repair/replacement down-time can be considerable and costly.

Figure 3:
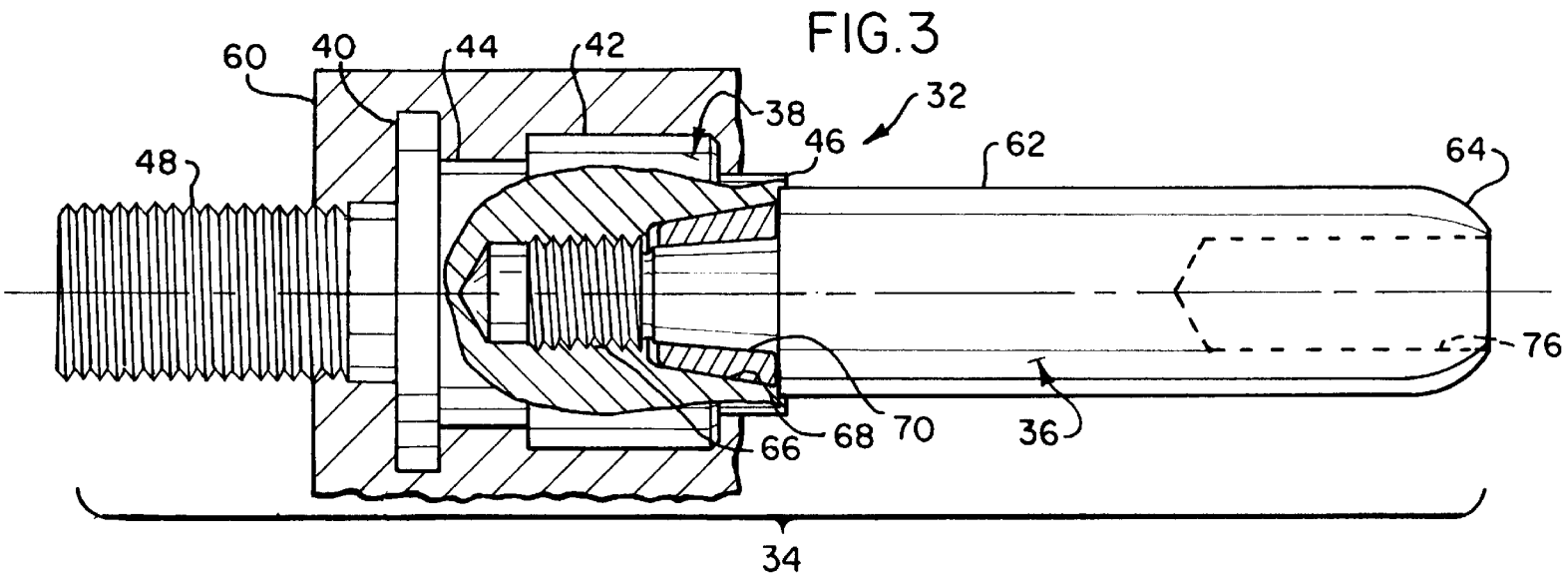
FIG. 3 is an elevational, sectional view of a pin contact assembly of the invention.
Figure 6:
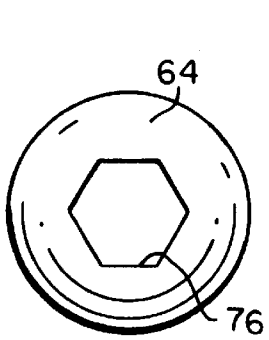
FIG. 6 is an end view of the pin body showing an opening for receiving a wrench.
Figure 5:
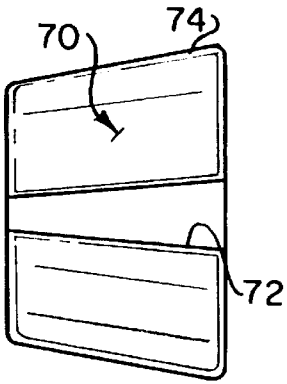
FIG. 5 is an elevational view of a double-tapered collet.

With reference now to FIG. 3, there is depicted a receptacle connector part 32 including a pin contact assembly 34 of the present invention. Interconnection with a cable wire, which can be identical to the cable 18, is conventional and is not shown. The pin contact assembly in its more general aspects includes a pin body 36 and an insert 38 which are releasably interconnected to one another both mechanically and electrically, in a way that will be more particularly described.

Figure 4:
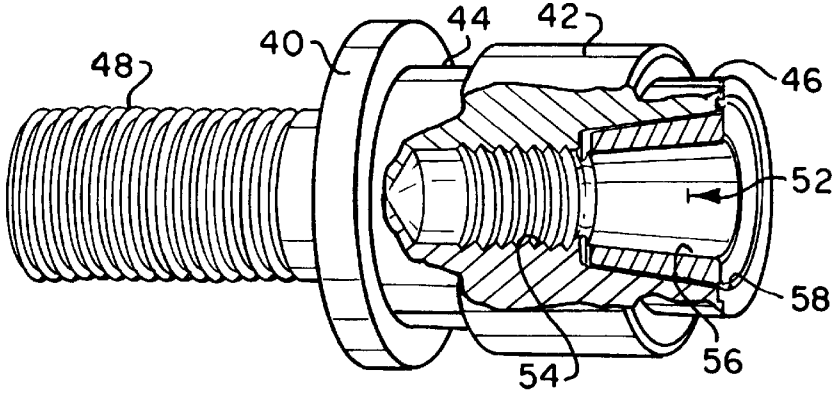
FIG. 4 is a perspective view of a pin contact threaded insert.

For the ensuing description of the insert 38, reference is made simultaneously to FIGS. 3 and 4. The insert is a generally cylindrical member having first and second enlarged cylindrical portions 40 and 42 separated by a cylindrical slot 44. A first outer end portion 46 has a lesser cross-sectional diameter than that of the immediately adjacent cylindrical portion 42. Extending oppositely from the enlarged portion 40 is a cylindrical threaded termination means 48 for interconnection to a cable wire (not shown). An axial opening 52 is formed in the outer end member 46 having an inner passage 54 which is threaded that is continuous with an outwardly tapering passage 56. An indented circular shoulder 58 is formed about the outermost end surface of the insert end member 46.

A block 60 of a moldable electrically insulative material is formed completely about and encasing the sides of a desired plurality of inserts 38. In this way, the material 60 encloses the inserts 38 except for the outermost end faces of the members 46, giving protection against the environment while having the axial opening 52 free to receive a pin body therein in a manner to be described.

The pin contact 36 of the invention includes an elongated cylindrical body 62 with an outer end 64 which is generally rounded, and at the other end a threaded portion 66 with an intervening tapered section 68 unitarily interrelating the threaded portion and body 62. The taper of section 68 is uniform with the smaller diameter cross-section being adjacent the threaded portion and the larger diameter adjacent body 62.

A cylindrical collet 70 has an axially extending relief slot 72 with an internal opening taper of a first angle substantially the same as that of tapered section 68 enabling sliding and fitting receipt thereon. The collet outer peripheral surface 74 has a taper of a second angle in the same direction as and greater than the internal opening taper first angle. The collet outer second angle taper closely matches the taper of the tapered wall 56 of the insert 38.

Also, the outer rounded end 64 of the pin contact body 62 has an axial extending opening 76 with a cross-section of such configuration and dimensions as to fittingly receive an Allen wrench (e.g., hex-head) therein for removing and replacing the pin 36 from the insert as needed.

To unite the pin assembly 34 with an insert 38, the pin body 62 first has a collet 70 received onto the body tapered section 68 following which the body 62 is then positioned within opening 52 and threaded into the insert passage 54. When fully assembled the double-tapered collet provides both a good mechanical connection as well as an excellent low-ohmage connection between the pin body 62 and the insert 38, and thus via a cable wire to equipment aboard the aircraft.

Although other metals may be found advantageous for making the described pin contact, best results to-date have been achieved by making the insert 38 of beryllium-copper, pin 36 of tellurium-copper, and collet 70 from an oxygen-free copper which has been fully annealed.

The differential tapered collet has been found to be relatively unaffected adversely by normal vibration frequencies and shock values to which aircraft components are subjected. Also, negligible thread "stretch" or fatigue is experienced when the pin body 62 is torqued the required amount to lock the collet in place. Moreover, disengagement of the component parts is obtained with 100% reliability. Still further, after exposure to vibrations, removal torque always exceeds assembly torque and the collet always comes off with the pin. Yet another advantageous feature of the collet is that the collet contact surfaces with both the insert and the pin body 62 each exceed the pin body cross-sectional area which results in the electrical resistance of pin assembly being substantially identical to the resistance of a one-piece pin contact of the prior art.

Although the present invention is described in connection with a preferred embodiment, it is to be understood that those skilled in the appertaining arts may make modifications that come within the spirit of the invention as described and within the scope of the appended claims.

What is claimed is:

1. An electrical contact assembly for use in a plug and receptacle connector with releasable complementary parts interrelating one or more cable wires, comprising:

a first electrically conductive member for direct connection to a cable wire having an opening therein including an internal threaded passage communicating with a tapered unthreaded passage that opens to the exterior of said first member;

a second electrically conductive member having a threaded portion of a size enabling threaded receipt within the first member threaded passage, an adjacent tapered extent positioned within the tapered unthreaded passage, and a contact portion for releasable engagement with a complementary connector part; and a tapered conductive collet received on the second conductive member tapered extent and contacting the same as well as the first member during assembly.

2. An electrical contact assembly as in claim 1, in which the collet includes a hollow tubular body with an internal taper of a first angle and an outer peripheral surface taper of a second angle differing from said first angle.

3. An electrical contact assembly as in claim 2, in which the collet includes a longitudinally extending slot enhancing transverse flexibility to conform to tapered surfaces of said first and second members during assembly.

4. An electrical contact assembly as in claim 1, in which there is further provided a block of electrically insulative material encasing said first electrically conductive member leaving unobstructed access to said tapered unthreaded passage and internal threaded passage.

5. An electrical contact assembly as in claim 1, in which said first electrically constructive member is constructed of beryllium-copper, said second electrically conductive member is constructed of tellurium-copper and said collet is constructed of oxygen-free copper fully annealed.

6. An electrical contact assembly as in claim 1, in which the second electrically conductive member is a pin contact including an elongated generally cylindrical pin body with a shallow opening in an outer end thereof of dimensions and geometry enabling receipt of a wrench therein to apply torque to said pin body about a cylindrical axis thereof.

7. An electrical contact assembly as in claim 3, in which the slot width is so dimensioned as to prevent facing slot sidewalls from contacting one another on assembly of the first and second electrically conductive members.

8. An electrical contact assembly as in claim 1, in which the second electrically conductive member is a pin contact having an elongated uniformly cylindrical pin body of predetermined cross-sectional area, and the collet has a contact area with both walls of the tapered unthreaded passage and the second electrically conductive member tapered extent which exceeds the pin body cross-sectional area.

9. In a receptacle connector mounted to the fuselage of an aircraft and accessible from the exterior for releasable mating with a complementary plug connector for reliably providing electrical power to the aircraft, comprising in combination the improvement of:

a plurality of metallic inserts encased within an insulative block with a surface of each said insert extending outwardly of said block in a common direction, each said insert including, a threaded opening, an extent of the opening free of threads immediately adjacent an outermost end of the opening, and a circular recessed flange surrounding the outermost end of the opening;

an elongated circular cross-section pin contact body having a threaded end for releasable threaded engagement with the threaded insert opening and an extent of the body inwardly of the threaded end which is free of threads; and a hollow tubular collet intervening between and engaging the thread free part of the insert opening and the unthreaded pin body extent.

* * * * *